US006437273B2

(12) United States Patent
Stechbarth et al.

(10) Patent No.: US 6,437,273 B2
(45) Date of Patent: Aug. 20, 2002

(54) HYBRID CIRCUIT BREAKER

(75) Inventors: Joachim Stechbarth, Untersiggenthal; Kurt Kaltenegger, Lengnau; Werner Hofbauer, Baden; Lutz Niemeyer, Birr; Max Claessens, Baden-Rütihof; Klaus-Dieter Weltmann, Baden-Dättwil; Christian Lindner, Zürich, all of (CH)

(73) Assignee: ABB T&D Technology AG, Zurich (CH)

( * ) Notice: Subject to any disclaimer, the term of this patent is extended or adjusted under 35 U.S.C. 154(b) by 0 days.

(21) Appl. No.: 09/729,190

(22) Filed: Dec. 5, 2000

(30) Foreign Application Priority Data

Dec. 6, 1999 (DE) ..... 199 58 645

(51) Int. Cl.[7] ..... H01H 9/40
(52) U.S. Cl. ..... 218/3; 218/7; 218/154
(58) Field of Search ..... 218/43–55, 65, 218/66, 69, 70, 71–78, 84, 154

(56) References Cited

U.S. PATENT DOCUMENTS

| | | | | |
|---|---|---|---|---|
| 4,434,332 A | * | 2/1984 | Yanabu et al. | 218/43 |
| 4,458,119 A | * | 7/1984 | Hashimoto et al. | 218/43 |
| 4,538,039 A | | 8/1985 | Gotoh et al. | |

FOREIGN PATENT DOCUMENTS

| | | |
|---|---|---|
| DE | 44 05 206 | 8/1995 |
| DE | 44 27 163 | 2/1996 |
| DE | 196 22 460 | 4/1998 |
| EP | 0 847 586 | 4/1999 |

OTHER PUBLICATIONS

Erk, A.; Schmelzle, M.: Grundlagen der Schaltgerätetechnik. Berlin [u.a.]: Springer, 1974, pp. 301–303 (No month).

* cited by examiner

*Primary Examiner*—Lincoln Donovan
(74) *Attorney, Agent, or Firm*—Burns, Doane, Swecker & Mathis, L.L.P.

(57) ABSTRACT

This hybrid circuit breaker has at least two series-connected arcing chambers which are operated by a common drive or by separate drives and are filled with different arc extinguishing media. The arc extinguishing and insulating medium in the first arcing chamber surrounds the second arcing chamber in an insulating manner. The aim is to provide a hybrid circuit breaker which can be produced economically and which has high availability. This is achieved, inter alia, wherein means are provided which always ensure that the movement of the first arcing chamber leads the movement of the second arcing chamber during a disconnection process, and that the movement of the second arcing chamber always leads the movement of the first arcing chamber during a connection process.

24 Claims, 8 Drawing Sheets

HYBRID CIRCUIT BREAKER

FIELD OF THE INVENTION

The invention is based on a hybrid circuit breaker.

BACKGROUND OF THE INVENTION

The document EP 0 847 586 B1 discloses a hybrid circuit breaker which can be used in an electrical high-voltage network. This hybrid circuit breaker has two series-connected arcing chambers, a first of which is filled with $SF_6$ gas as an arc extinguishing and insulating medium, and a second of which is in the form of a vacuum switching chamber. The second arcing chamber is surrounded by $SF_6$ gas on the outside. The main contacts in the two arcing chambers are operated simultaneously via a lever transmission from a common drive. Both arcing chambers have a power current path, in which the consumable main contacts are located, and a rated current path in parallel with it, with this rated current path having only a single interruption point. On disconnection, the rated current path is always interrupted first, after which the current to be disconnected commutates onto the power current path. The power current path then continues to carry the current until it is definitively disconnected.

In this hybrid circuit breaker, the arc which always occurs in the vacuum switching chamber during disconnection burns for approximately the same time period as in the gas-filled first arcing chamber, which means that the main contacts in the vacuum switching chamber are subjected to a comparatively high and long-lasting current load and, linked to this, a high wear rate, which means that maintenance work has to be carried out comparatively frequently, as a result of which the availability of the hybrid circuit breaker is limited. This hybrid circuit breaker requires a comparatively large amount of drive energy since, depending on the switching principle used in the gas-filled first arcing chamber, the drive has to produce all or part of the high gas pressure required for intensively blowing out the arc. Such a drive, which is designed to be particularly powerful, is comparatively expensive. In this switch, the returning voltage is distributed capacitively between the two arcing chambers, with the intrinsic capacitances of the arcing chambers being the critical factor.

Laid-open specification DE 4 427 163 A1 discloses a compressed-gas circuit breaker whose arcing chamber has two main contacts which move in opposite directions. Part of the pressurized gas for blowing out the arc is produced by the arc itself and is stored in a storage volume, while the rest is produced in a piston-cylinder arrangement, depending on the movement of the main contacts, and, when required, this other part flows through the storage volume and blows out the arc. In this compressed-gas circuit breaker, the aim is for the arc to be blown out intensively, and this requires a comparatively high arc extinguishing gas pressure. The drive for the compressed-gas circuit breaker must therefore be powerful in order to allow the main contacts to move against this comparatively high arc extinguishing gas pressure.

In the known hybrid circuit breakers and conventional circuit breakers, the aim is always for the arc to be blown out as intensively as possible in the arcing chamber which is generally filled with a gaseous insulating and arc extinguishing medium. This intensive blowing is necessary in order to achieve good arc cooling and to ensure that the arc is extinguished properly, and that ionized gases and erosion particles are very rapidly removed from the extinguishing path. Once the arc has been extinguished, a major portion of the returning voltage is borne by this extinguishing path from the start. As a rule, such intensive blowing is achieved only if the flow rate of the blowing medium is in the supersonic speed range.

SUMMARY OF THE INVENTION

The invention, achieves the object of providing a hybrid circuit breaker which can be produced economically and which has high availability, and of specifying a method for its operation.

In this hybrid circuit breaker the first, steep rise in the returning voltage is borne essentially by the second arcing chamber, which is in the form of a vacuum switching chamber. Accordingly, the dielectric recovery of the extinguishing path in the first arcing chamber may take place comparatively slowly, which means that the blowing in the first arcing chamber may be considerably weaker than in conventional circuit breakers. Considerably less energy thus needs to be consumed to provide the pressurized gas required for blowing out the arc.

The advantages achieved by the invention are that the hybrid circuit breaker can be equipped with a considerably weaker and thus more economic drive for the same power switching capacity. Furthermore, the pressures which occur in the first arcing chamber in this hybrid circuit breaker are considerably lower than in conventional circuit breakers, so that the insulating tube and the other parts that are subjected to pressure can be designed for reduced loads as well, thus making it possible to design the hybrid circuit breaker to be more economic. Furthermore, it is advantageous that the flow rate of the gas which cools the arc in the first arcing chamber may be in the subsonic range since the blowing required in this case is considerably less intensive and, in consequence, the amount of pressurized gas that needs to be provided for blowing can be kept comparatively small.

A further advantage is that the main contacts in the second arcing chamber which, in this case, is in the form of a vacuum switching chamber have a longer life owing to the shorter duration of the current load during disconnection, and this results in improved operational availability of the hybrid circuit breaker. The time delay in the disconnection movement of the second arcing chamber in comparison to the first has the major advantage when asymmetric short-circuit currents are being disconnected that the second arcing chamber is loaded with considerably lower peak currents, since the asymmetry of the short-circuit currents decays even further during this delay time. If the second arcing chamber is in the form of a vacuum switching chamber, then this has a particularly advantageous effect on the life of the contacts.

The hybrid circuit breaker is provided with at least two series-connected arcing chambers which are operated by a common drive or by separate drives and are filled with different arc extinguishing media, wherein the arc extinguishing and insulating medium in the first arcing chamber surrounds the second arcing chamber in an insulating manner. Means are provided which ensure that the movement of the first arcing chamber leads the movement of the second arcing chamber during a disconnection process. A gas or a gas mixture is used as the arc extinguishing and insulating medium in the first arcing chamber. At least one vacuum switching chamber is provided as the second arcing chamber. However, other switching principles may also be used for the second arcing chamber, and, in particular, the second arcing chamber may also be in the form of a TVG (Triggered Vacuum Gap).

BRIEF DESCRIPTION OF THE DRAWINGS

The invention, its development and the advantages which can be achieved by it are explained in more detail in the following text with reference to the drawing, which illustrates only one possible embodiment.

In the figures.

In all the figures, elements having the same effect are provided with the same reference symbols. Only those elements which are required for direct understanding of the invention are illustrated and described.

DETAILED DESCRIPTION OF THE PREFERRED EMBODIMENTS

Figure 1:
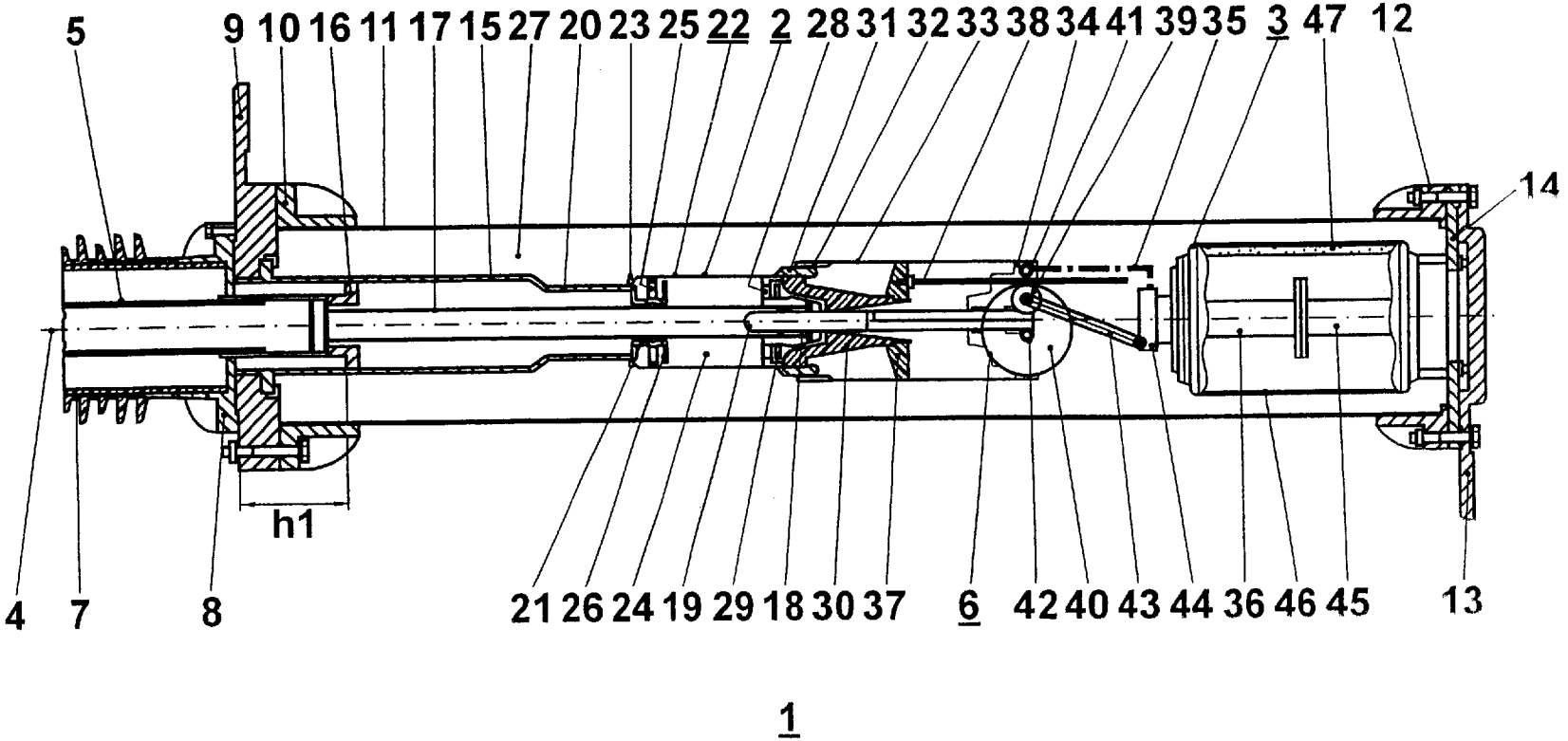
FIG. 1 shows a first embodiment of a hybrid circuit breaker, illustrated in highly simplified form, in the connected state, in which the arc in the first arcing chamber is blown out by gas which is compressed in a piston-cylinder arrangement.

FIG. 1 shows a first embodiment of a hybrid circuit breaker 1, illustrated in highly simplified form, in the connected state. This hybrid circuit breaker 1 has two series-connected arcing chambers 2 and 3 which in this case are mounted such that they extend along a common longitudinal axis 4 and are arranged concentrically with respect to this axis. It is entirely possible in other embodiments of this hybrid circuit breaker 1 to arrange the arcing chambers 2 and 3 on different longitudinal axes, angled with respect to one another. It is even feasible in the variant with angled longitudinal axes for these longitudinal axes not only to lie in a plane or in two planes arranged parallel to one another, but also for these planes to intersect at an angle which is useful for design purposes.

The hybrid circuit breaker 1 is driven by a drive (not illustrated) via a drive rod 5 which is composed of electrically insulating material. A conventional energy storage drive may be provided as the drive. However, it is also possible to use an electronically controllable DC drive without the interposition of any energy store. This design variant may be regarded as being particularly economic and, furthermore, it allows the contact movement speeds of the hybrid circuit breaker 1 to be matched to the respective particular operational requirements using simple means. A gearbox 6 is arranged between the two arcing chambers 2 and 3, links the movements of the two arcing chambers 2 and 3 to one another and matches the movement sequences to one another in a technically sensible manner.

The drive rod 5 is protected against environmental influences by a supporting insulator 7 to which the arcing chambers 2 and 3 of the hybrid circuit breaker 1 are fitted. The supporting insulator 7 is connected in a pressuretight manner on the electrical ground side to the drive (which is not illustrated), and on the arcing chamber side it is provided with a metallic flange 8 which is screwed to a first metallic connection flange 9. The drive side of the arcing chamber 2 is connected to the electrical power supply system via the connecting flange 9. Furthermore, a first end flange 12 of an arcing chamber housing 11 is screwed to the connecting flange 9. The arcing chamber housing 11 is cylindrical, pressuretight and electrically insulating, extends along the longitudinal axis 4 and surrounds the two arcing chambers 2 and 3 and the gearbox 6. On the side opposite the first end flange 10, the arcing chamber housing 11 has a second metallic end flange 12, which is screwed to a second metallic connecting flange 13. The side of the arcing chamber 3 facing away from the drive is connected via the connecting flange 13 to the electrical power supply system. A metallic mounting plate 14 is held between the end flange 12 and the connecting flange 13.

The connecting flange 9 is rigidly and electrically conductively connected to the cylindrical metallic mounting tube 15, which is arranged concentrically with respect to the longitudinal axis 4. The mounting tube 15 has openings (which are not illustrated) which are used to exchange gas between the interior of the mounting tube 15 and the rest of the arcing chamber volume. The inner part of the mounting tube 15 on the drive side is used as a guide for a guide part 16, which is connected to the drive rod 5 and supports said drive rod 5 against the mounting tube 15. The guide part 16 is designed such that it limits the travel h1 of the drive rod 5 when the hybrid circuit breaker 1 is in the disconnected position.

At the end, the drive rod 5 is connected to a metallic contact tube 17, which represents a first moving power contact in the first arcing chamber 2. The shaft of the contact tube 17 has openings (which are not illustrated) which are used for exchanging gas between the interior of the contact tube 17 and the interior of the mounting tube 15. On the side facing away from the drive, the contact tube 17 is provided with sprung consumable fingers 18, which are arranged in a tulip shape. The consumable fingers 18 enclose and make contact with a metallic consumable pin 19. The consumable pin 19 extends axially in the center of the arcing chamber 2, and is arranged such that it can move axially. The consumable pin 19 always moves in the opposite direction to the movement direction of the contact tube 17. The consumable pin 19 represents the second moving power contact in the first arcing chamber 2.

On the side facing away from the drive, the supporting tube 15 has a narrowed region 20 and a guide element 21 which guides the contact tube 17. The guide element 21 is provided internally with spiral contacts (which are not illustrated) which allow current to be transferred properly from the mounting tube 15 to the contact tube 17. A metallic nozzle holder 22 slides on the outside of the narrowed region 20 and is equipped on the drive side with sliding contacts 23 which allow the current to be transferred properly from the mounting tube 15 to the nozzle holder 22.

The nozzle holder 22 encloses a compression volume 24. On the drive side, the compression volume 24 is closed off by a non-return valve 25, which is held by the guide element 21. The non-return valve 25 has a valve disk 26 which prevents compressed gas from emerging into the arcing chamber volume 27, which is common to both arcing chambers 2 and 3, when the pressure in the compression volume 24 is raised. A further non-return valve 28, which is held in the nozzle holder 22, is provided on the opposite side of the cylindrical compression volume 24, and its valve disk 29 allows compressed gas to emerge from this compression volume 24 when the pressure in the compression volume 24 is raised.

An insulating nozzle 30 is held in the nozzle holder 22, on the side facing away from the drive. The insulating nozzle 30 is arranged concentrically around the consumable pin 19. The contact tube 17, the nozzle holder 22 and the insulating nozzle 30 form an integral assembly. The nozzle constriction is arranged immediately in front of the consumable fingers 18, and the insulating nozzle 30 opens in the opposite direction to the consumable fingers 18. On the outside, the nozzle holder 22 has a thickened region 31 which is designed as a contact point. When the arcing chamber 2 is in the connected state, sliding contacts 32 rest on this thickened region 31. These sliding contacts 32 are connected to a cylindrical metallic housing 33, which is held by a metallic guide part 34 mounted in a fixed position. Sliding contacts (which are not illustrated) are provided in a central hole in the guide part 34 and connect the guide part 34 to the consumable pin 19 in an electrically conductive manner. As indicated by a line of action 35, the current path passes from the guide part 34 via a connecting part 44 on to the moving contact 36 in the second arcing chamber 3.

An electrically insulating holding disk 37 is mounted rigidly on the insulating nozzle 30, on its side facing away from the drive. The holding disk 37 may, however, also be composed of a metal provided the dielectric conditions in this region allow. A toothed rod 38 is screwed into this holding disk 37, extends parallel to the longitudinal axis 4, and operates the gearbox 6. The toothed rod 38 engages with two gearwheels 39 and 40, and is pressed against these gearwheels 39 and 40 by a supporting roller 41. A groove which is provided with teeth is incorporated in the shaft of the consumable pin 19, which is guided by the guide part 34, and the gearwheel 39 engages in this groove. A further supporting roller 42 presses the shaft of the consumable pin 19 against the gearwheel 39. The gearwheel 40 operates the second arcing chamber 3 via a lever 43 which is coupled to it such that it can move. The lever 43 is coupled to the connecting part 44, which is electrically conductively connected to the moving contact 36 in the second arcing chamber 3.

Here, the second arcing chamber 3 is illustrated schematically as a vacuum switching chamber. For example, it is also possible for the switching point in this arcing chamber 3 to operate on the basis of other switching principles. The arcing chamber 3 is surrounded by the insulating medium which fills the common arcing chamber volume 27. The arcing chamber 3 has a stationary contact 45 which is electrically conductively connected to the mounting plate 14. The mounting plate 14 is used to fix the arcing chamber 3. The arcing chamber 3 has an insulating housing 46 which separates the interior of the arcing chamber 3 from the arcing chamber volume 27 in a pressuretight manner. The insulating housing 46 is illustrated partially cut open here.

The wall of the insulating housing 46 is provided with a resistance coating 47. This resistance coating 47, which is intended to satisfy the necessity to control the distribution of the returning voltage between the two arcing chambers 2 and 3 during disconnection, may be applied to the inner or to the outer surface of the insulating housing 46. This propitious configuration of the resistance coating advantageously allows the dimensions of the second arcing chamber 3 to be kept small. The electrical resistance of the resistance coating is in the range between 10 kΩ and 500 kΩ, and it has been found to be particularly advantageous for the resistance value to be 100 kΩ.

The common arcing chamber volume 27 is filled with a gas or gas mixture which has an electrically insulating effect and is used not only as an arc extinguishing medium for the first arcing chamber 2 but also as an insulating medium. The gas or gas mixture binds free electrons to its molecules, thus suppressing the propagation of electrostatic charges and thus the charging of insulating parts. In order to avoid electrically conductive reaction products, metal vapor, for example, is converted into fluorides or, if required, is also oxidized by free oxygen. The filling pressure is in this case in the range from 3 bar to 22 bar, and a filling pressure of 9 bar is preferably provided. Pure $SF_6$ gas or a mixture of $N_2$ gas and $SF_6$ gas is used as the arc extinguishing and insulating medium. However, it is also possible to use a mixture composed of compressed air and $N_2$ gas, and other electrically negative gases, in this case. Gas mixtures with a proportion of from 5% to 50% of $SF_6$ gas have been proven in particular. However, a mixture composed of $CO_2$ gas with $O_2$ gas can also be used as an arc extinguishing gas, with the proportion of $O_2$ being in the range from 5% to 30%. Furthermore, a mixture composed of $CH_4$ gas with $H_2$ gas may be used, with the proportion of $H_2$ being in the range from 5% to 30%. The two last-mentioned arc extinguishing gas mixtures are used in particular when consumable contacts composed of graphite are provided, since these gas mixtures render the eroded graphite particles safe. However, other gases and gas mixtures are also feasible.

Figure 7:
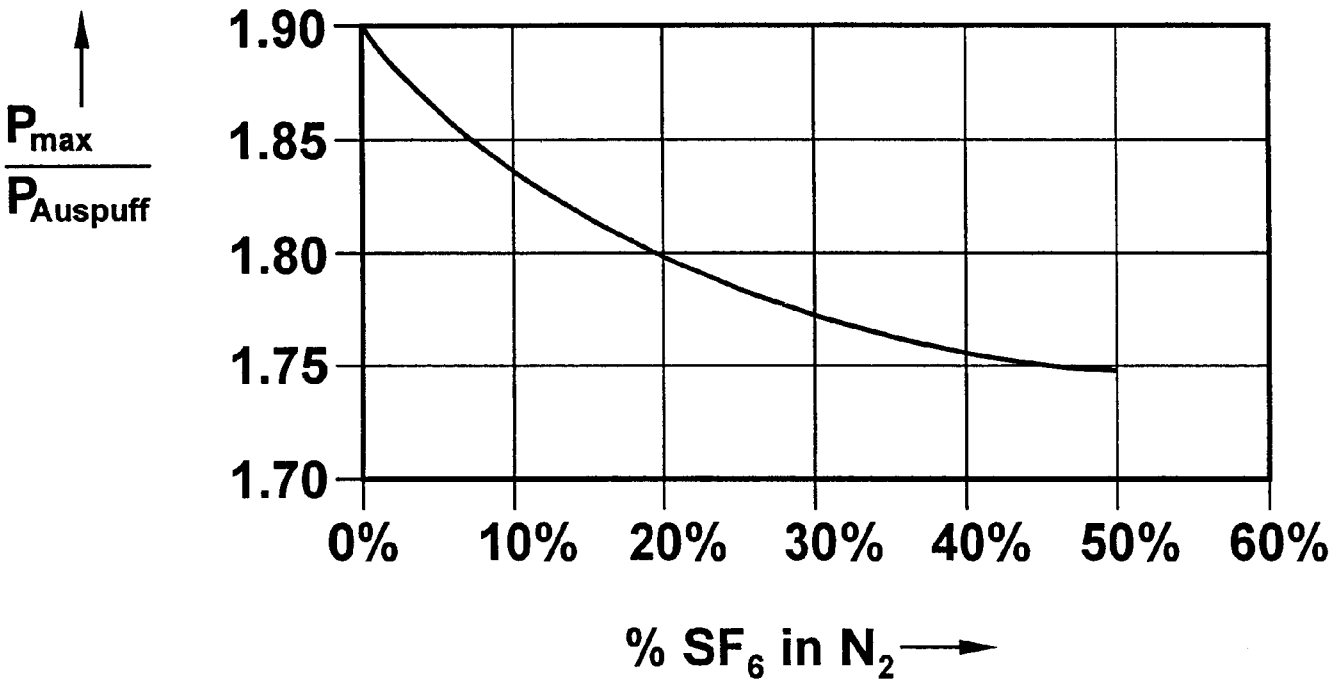
FIG. 7 illustrates a critical pressure ratio.

FIG. 7 shows a critical pressure ratio for the filling of the first arcing chamber 2 with a mixture composed of $SF_6$ gas and $N_2$ gas. Care should be taken to ensure that this critical pressure ratio is not exceeded despite the influence of the energy released in the arc, so that it is always possible to keep the flow rate of the gas which is blowing out the arc in the range below the speed of sound. The ratio between the maximum pressure $P_{max}$ that occurs and the exhaust pressure $P_{exhaust}$ in the first arcing chamber 2 is plotted on the ordinate axis of the graph and the proportion of $SF_6$ gas in the filling is plotted, as a percentage, on the abscissa axis. As can be seen, the critical pressure ratio becomes lower as the proportion of $SF_6$ gas increases, so that the pressure for blowing out the arc in the first arcing chamber 2 can advantageously be kept low. If the first arcing chamber 2 is filled with a gas mixture having a different composition, for example one of those mentioned above, then care must likewise be taken to ensure that the critical pressure ratio appropriate to this gas mixture is not exceeded since this is the only way to ensure that the flow rate of the gas which is blowing out the arc is always kept in the range below the speed of sound.

Flow rates in the range below the speed of sound can be coped with more easily since this avoids the decrease in density that occurs in the flow channel with supersonic flows, thus in this case allowing the development cost advantageously to be kept low in comparison with that for conventional circuit breakers.

In the connected state, the hybrid circuit breaker 1 carries the current via the following current path, which is referred to as the rated current path: connecting flange 9, mounting tube 15, nozzle holder 22, housing 33, guide part 34, line of action 35, connecting part 44, moving contact 36, stationary contact 45, mounting plate 14 and connecting flange 13. However, particularly if the hybrid circuit breaker 1 has to be designed for comparatively high rated currents, it is also possible to provide a separate rated current path, which is suitable for high rated currents, in parallel with the second arcing chamber 3.

When the hybrid circuit breaker 1 receives a disconnection command, then the drive (which is not illustrated) moves the contact tube 17 and, with it, the insulating nozzle 30 to the left. At the same time as this movement, the consumable pin 19 is moved, driven by the toothed rod 38 and via the gearwheel 39, in the opposite direction to the right, while the housing 33 and the guide part 34 remain in fixed positions. As soon as the thickened region 31 of the nozzle holder 22 has been disconnected from the sliding contacts 32 of the housing 33, the rated current path mentioned above is interrupted and the current to be disconnected now commutates onto the power current path, which is located on the inside. The power current path passes through the following parts of the circuit breaker: connecting flange 9, mounting tube 15, guide element 21, contact tube 17, consumable pin 19, guide part 34, line of action 35, connecting part 44, moving contact 36, stationary contact 45, mounting plate 14 and connecting flange 13.

The contact tube 17 and, with it, the insulating nozzle 30 are moved further to the left once the rated current path has been interrupted, and the consumable pin 19 is moved further in the opposite direction, at the same speed. The contact disconnection in the power current path takes place after this in the course of this movement sequence. This contact disconnection results in an arc being formed between the consumable fingers 18 and the tip of the consumable pin 19 in an arcing space 48 provided for this purpose.

Generally, the second arcing chamber 3 remains closed until this time. It opens only after a time delay $T_v$, which is defined by the following relationship:

$$T_v=(t_{Libo\ min}-t_1)\ ms.$$

Figure 2:
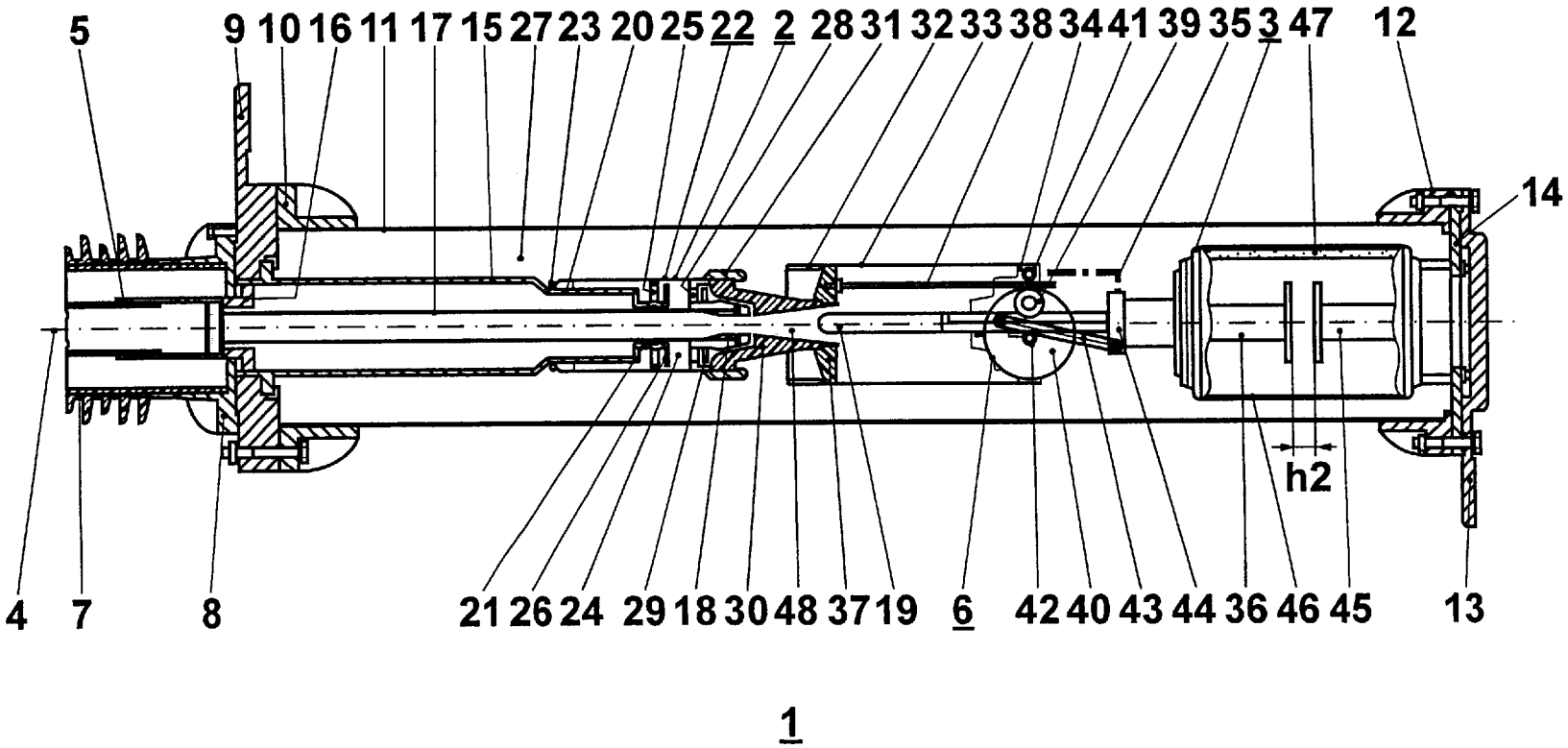
FIG. 2 shows this first embodiment of the hybrid circuit breaker, illustrated in highly simplified form, in the disconnected state.

In this case, $t_{Libo\ min}$ is the minimum possible arcing time in ms for the arcing chamber 2 into which gas is being blown, and this arcing time is determined by the power supply system data for the respective location of the hybrid circuit breaker 1 and by the characteristics of the hybrid circuit breaker 1, for example its intrinsic operating time. The time $t_1$ is in the range from 2 ms to 4 ms. This time delay $T_v$ is produced, such that it cannot be circumvented, by the gearbox 6. The second arcing chamber 3 also has a considerably shorter travel h2 than the arcing chamber 2, as can be seen in FIG. 2.

During the disconnection movement of the first arcing chamber 2, the gas or gas mixture located in the compression volume 24 is compressed, but the non-return valve 25 prevents the compressed gas from emerging into the common arcing chamber volume 27 on the side of the compression volume 24 remote from the insulating nozzle 30. A comparatively small amount of compressed gas flows through the non-return valve 28 into the arcing space 48 at this stage, provided the pressure conditions there allow this. The diameter of the constriction in the insulating nozzle 30, the diameter of the consumable pin 19, which is still a considerable proportion of this nozzle constriction at the start of the disconnection movement and also closes the outlet flow cross section through the consumable fingers 18, and the internal diameter of the contact tube 17 are matched to one another such that, while the arc is being blown out, sufficient gas or gas mixture composed of unionized and ionized gas is always carried out from the arcing space 48 so that only a gas pressure which is considerably less than that in conventional circuit breakers can build up there. The magnitude of this gas pressure is fixed such that the outlet flow speed from the arcing space 48 is generally in the range below the speed of sound. As a consequence of these comparatively low pressures in the arcing space 48, the pressure build up in the compression volume 24 can likewise be kept comparatively small, so that only a comparatively small amount of drive energy is required for the compression process. In comparison to conventional circuit breakers, a weaker and thus lower-cost drive can thus advantageously be used here for the hybrid circuit breaker 1, since the gas pressures during disconnection are lower.

Immediately after contact disconnection in the power current path, the consumable pin 19 releases a greater portion of the cross section of the narrowed region of the insulating nozzle 30 than the outlet flow cross section. The process of blowing out the arc which is burning in the arcing space 48 when the disconnection currents are comparatively small actually starts on contact disconnection. The arc extinguishing and insulating medium always flows during this blowing process at a flow rate which is in the range below the speed of sound. When larger currents are being disconnected, as can occur, for example, when disconnecting short circuits in the power supply system, the arc heats the arcing space 48 and the gas contained in it so intensively that the pressure in this space is somewhat higher than the pressure in the compression volume 24. In this case, the non-return valve 28 prevents the heated and pressurized gas from flowing into the compression volume 24, and prevents the possibility of it being stored there. Instead of this, the heated and pressurized gas flows away, firstly through the interior of the contact tube 17 and secondly through the insulating nozzle 30, into the common arcing chamber volume 27. In this case, the process of blowing out the arc does not start until the intensity of the arc and thus the pressure in the arcing space 48 have decayed to such an extent that the non-return valve 28 can open, that is to say the pressure in the compression volume 24 is then higher than the pressure in the arcing space 48. In this case, while the arc is being blown out, the arc extinguishing and insulating medium also flows at a flow rate which is in the range below the speed of sound.

In this embodiment of the hybrid circuit breaker 1, the arcing space 48 of the first arcing chamber 2 is designed such that it is impossible for any significant amount of pressurized gas produced by the arc itself to be stored, and, as a consequence of this, no significant assistance is given to the process of blowing out the arc by pressurized gas produced by the arc itself either, since this is the only way to make it possible to ensure that the flow rate is in the subsonic range while the arc is being blown out.

Once the arcing chambers 2 and 3 have extinguished the arc, a portion of the returning voltage always occurs between the consumable fingers 18 and the consumable pin 19 in the arcing chamber 2, and between the moving contact 36 and the stationary contact 45 in the arcing chamber 3. The switching path of the vacuum switching chamber always recovers more quickly after an arc has been extinguished than the switching path in a gas circuit breaker, so that the vacuum switching chamber will carry the majority of this voltage at the start of the rapid rise in the returning voltage. The splitting of the returning voltage between two series-connected arcing chambers is normally governed by the intrinsic capacitances of the two arcing chambers. However, the comparatively high resistance of the resistance coating 47 which is arranged in parallel with the second arcing chamber 3 in this case ensures, in a precisely defined manner, that the returning voltage is split between the two arcing chambers 2 and 3 such that, initially, the majority of the returning voltage is once again applied to the second arcing chamber 3. Only as the disconnection process progresses further does the first arcing chamber 2 then take over the majority of the returning voltage which is then applied to the hybrid circuit breaker 1 overall. When the hybrid circuit breaker 1 is in the disconnected state, the first arcing chamber 2 then bears the majority of the applied voltage.

FIG. 2 shows the hybrid circuit breaker 1 in the disconnected state. When the hybrid circuit breaker 1 is being connected, the second arcing chamber 3 always closes first, to be precise without any current being applied. This timing is ensured by the gearbox 6. Once the second arcing chamber 3 has closed, the two moving contacts of the power current path in the first arcing chamber 2 then move toward one another. When the appropriate prestriking distance is reached, a connection arc is formed, and this closes the circuit. The two moving contacts of the power current path in the arcing chamber 2 move further toward one another until they make contact. The rated current path is not closed until this has been done and, from then on, the current is carried through the arcing chamber 2. The two moving contacts of the power current path in the arcing chamber 2 now move somewhat further until, in the end, they have reached the definitive connected position.

It has been found to be particularly advantageous in this hybrid circuit breaker 1 that the second arcing chamber 3 is switched on without any current flowing and that, therefore, it is not subjected to any contact wear during connection or to contacts sticking as a consequence of overheated contact surfaces being welded, either. Providing the operating conditions are normal, the contacts 36 and 45 do not need to be replaced during the life of the hybrid circuit breaker 1, thus advantageously simplifying operational maintenance of the hybrid circuit breaker 1, and advantageously increasing its operational availability.

Figure 3:
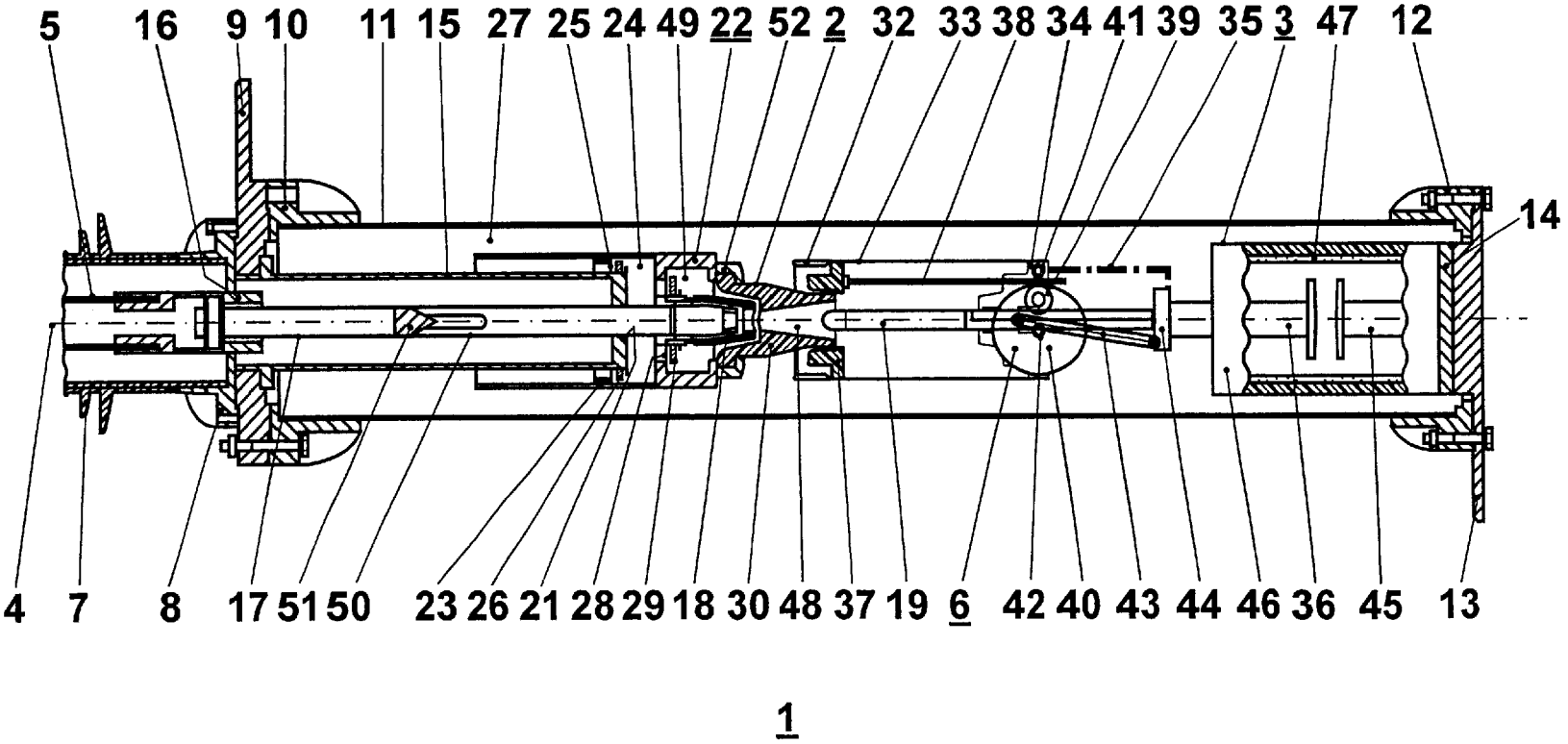
FIG. 3 shows a second embodiment of a hybrid circuit breaker, illustrated in highly simplified form, in the disconnected state, in which the arc in the first arcing chamber is blown out by gas which is stored in a storage volume and is pressurized by the arc itself, in conjunction with gas which is compressed in a separate piston-cylinder arrangement.

FIG. 3 shows a second embodiment of a hybrid circuit breaker 1, illustrated in highly simplified form, in the disconnected state. This embodiment is different to the first embodiment shown in FIGS. 1 and 2 in that an additional, cylindrical storage volume 49 is provided between the compression volume 24 and the arcing space 48, which storage volume 49 is intended for storage of at least a portion of the gas which is pressurized by the arc. A non-return valve 28 with a valve disk 29 is provided between the storage volume 49 and the compression volume 24 and, if the pressure conditions are appropriate, allows gas to flow from the compression volume 24 into the storage volume 49. The rest of the design of this hybrid circuit breaker 1 corresponds in principle to that of the first embodiment. The openings 50 in the contact tube 17 are shown here, through which gas flowing out of the arcing space 48 can flow away into the interior of the mounting tube 15. This process of flowing away is made easier by a flow cone 51 fitted in the interior of the contact tube 17. A metallic contact ring 52 is integrated in the nozzle holder 22, on which contact ring the sliding contacts 32 of the housing 33 rest when the circuit breaker is in the connected state, and thus close the rated current path.

The method of operation of this second embodiment corresponds approximately to the method of operation of the hybrid circuit breaker 1 described in conjunction with the first embodiment, with the only addition being that the compressed gas produced by the arc in the arcing space 48 can flow into the storage volume 49. This compressed gas is stored there until the pressure conditions in the arcing space 48 allow this compressed gas to flow back into the arcing space 48, with the arc being blown and cooled in the process. As soon as the storage pressure has fallen further, the non-return valve 28 opens and compressed fresh gas then flows out of the compression volume 24 and assists the process of blowing out the arc. By optimizing the size of the storage volume 49, the diameter of the constriction in the insulating nozzle 30 and the diameter of the contact tube 17, and by matching these three variables to one another, the pressure rise in the arcing space 48, and thus also in the storage volume 49, can be set such that the arc is effectively blown out without the pressure in the compression volume 24 having to become excessive, however. This means that the drive can be designed to be weaker, and can thus be produced at a lower cost. This embodiment as well results in the gas being used to blow the arc flowing at a speed which is in the subsonic range.

In this second embodiment of the hybrid circuit breaker 1, the second arcing chamber 3 is likewise opened with a time delay with respect to the first arcing chamber 2 during disconnection, and is closed with a time lead during connection, as has already been described.

Figure 4:
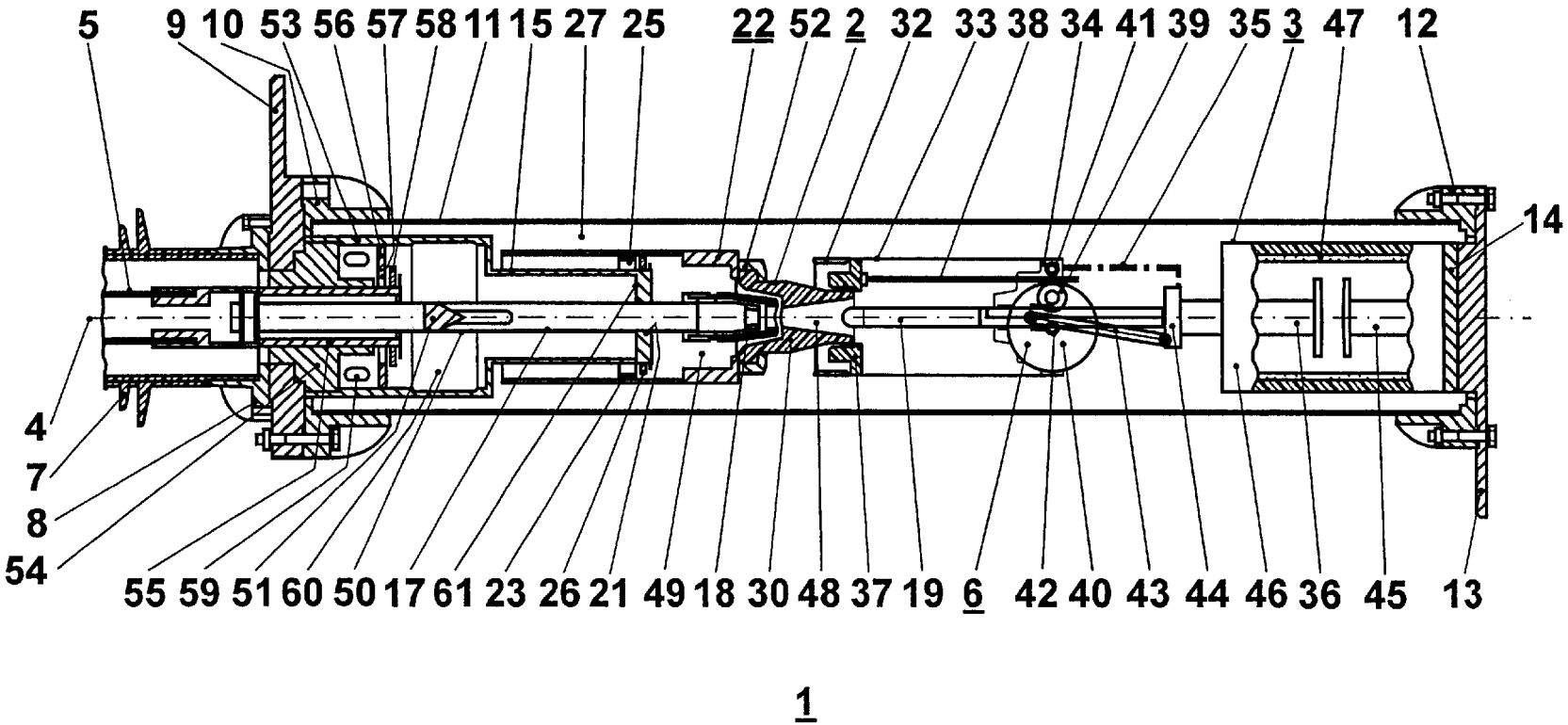
FIG. 4 shows a third embodiment of a hybrid circuit breaker, illustrated in highly simplified form, in the disconnected state, in which the arc in the first arcing chamber is blown out by gas which is stored in a storage volume and is pressurized by the arc itself, with a portion of the gas in the storage volume additionally being compressed by means of a piston during disconnection.

FIG. 4 shows a third embodiment of a hybrid circuit breaker 1, illustrated in highly simplified form, in the disconnected state. This embodiment is different to the second embodiment shown in FIG. 3 in that it has no separate compression volume separated from the storage volume 49 by a non-return valve. In this case, a cylindrical storage volume 49, of somewhat larger size, is connected to the arcing space 48 and is intended for storage of at least a portion of the gas which is pressurized by the arc. However, a part of this storage volume 49 is mechanically compressed during the disconnection process. A non-return valve 25, which acts as a compression piston during disconnection and is provided with a valve disk 26, is provided between the storage volume 49 and the arcing chamber volume 27 and, if the pressure conditions are appropriate, allows gas to flow from the arcing chamber volume 27 into the storage volume 49. The rest of the design of this hybrid circuit breaker 1 in principle corresponds to that of the second embodiment shown in FIG. 3. The openings 50 in the contact tube 17 are likewise shown here, through which gas flowing out of the arcing space 48 can flow away into the interior of the mounting tube 15. This process of flowing away is made easier by a flow cone 51 fitted in the interior of the contact tube 17.

By optimizing the size of the storage volume 49, the diameter of the constriction in the insulating nozzle 30 and the diameter of the contact tube 17, and by matching these three variables to one another, the pressure rise in the arcing space 48, and thus also in the storage volume 49, can be set such that the arc is effectively blown out. This embodiment as well results in the gas being used to blow the arc flowing at a speed which is in the subsonic range.

In this third embodiment of the hybrid circuit breaker 1, the second arcing chamber 3 is likewise always opened with a time delay with respect to the first arcing chamber 2 during disconnection, and is always closed with a time lead during connection, as has already been described.

In this third embodiment, shown in FIG. 4, an additional piston-cylinder arrangement is provided on the drive side, which provides power to assist the disconnection movement of the arcing chamber 2 with the aid of the pressurized gas produced by the energy of the arc. On the drive side, the mounting tube 15 has a widened region in the form of a cylinder 53. The cylinder 53 is held by a metallic guide flange 54, which is electrically conductively connected to the connecting flange 9. A sleeve 55 slides in the guide flange 54, is connected to the drive rod 5 and is moved by it, together with the contact tube 17. A piston 56, which has openings 57 passing through it, is mounted on the side of the sleeve 55 remote from the drive rod 5. The piston 56 passes through the cylinder 53. A valve disk 58 is, furthermore, held on the side of the sleeve 55 remote from the drive rod 5 and closes the openings 57 when the pressure on the side of the piston 56 facing away from the drive rod 5 is higher than that on the side facing the drive rod 5. In the region located between the disconnected position of the piston 56 and the end of the cylinder 53 on the drive side, the cylinder 53 has apertures 59 which connect this volume to the arcing chamber volume 27. The rest of the mounting tube 15 has no connections for the arcing chamber volume 27.

The inner surface of the cylinder 53 has a region 60 in which the internal diameter of the cylinder 53 is larger than the external diameter of the piston 56, to be precise this being the region which the piston 56 passes through during disconnection before the contact disconnection between the consumable fingers 18 and the consumable pin 19 takes place, that is to say before any arc occurs. This configuration of the cylinder 53 advantageously reduces the friction between the cylinder wall and the piston 56. As soon as the arc occurs during disconnection, gas flows through the contact tube 17 and the openings 50 into the interior of the mounting tube 15, where it increases the pressure so that the pressure in the interior is higher than in the arcing chamber volume 27. The valve disk 58 then closes the openings 57 and the pressure acts on the piston 56 which now, after leaving the region 60, is carried back through the cylinder 53 and assists its movement in the disconnection direction. The force acting in the disconnection direction is composed of the force acting on the piston 56 minus the force acting in the opposite direction, which is caused by the pressure applied to the considerably smaller end-face surface 61 of the mounting tube 15. This means that the drive can be designed to be weaker and can thus be produced at a lower cost, since this additional force is advantageously available precisely when the forces which act against the disconnection movement, for example the force which is caused by the pressure in the storage volume 49, occur.

The method of operation of this third embodiment corresponds approximately to the method of operation of the hybrid circuit breaker 1 described with respect to electrical disconnection in conjunction with the first embodiment, with the only addition being that compressed gas which is produced by the arc in the arcing space 48 can also flow into the storage volume 49. This compressed gas is stored there, and is partially also compressed during the disconnection movement, until the pressure conditions in the arcing space 48 allow this compressed gas to flow back into the arcing space 48, blowing and cooling the arc in the process.

This assistance, described above, to the drive forces based on the differential piston principle can advantageously be provided for any of the embodiments of the hybrid circuit breaker 1 described here. This measure makes it possible to reduce the requirement for mechanical drive energy further, and to reduce the cost of the drive further, in a simple manner.

Figure 5:
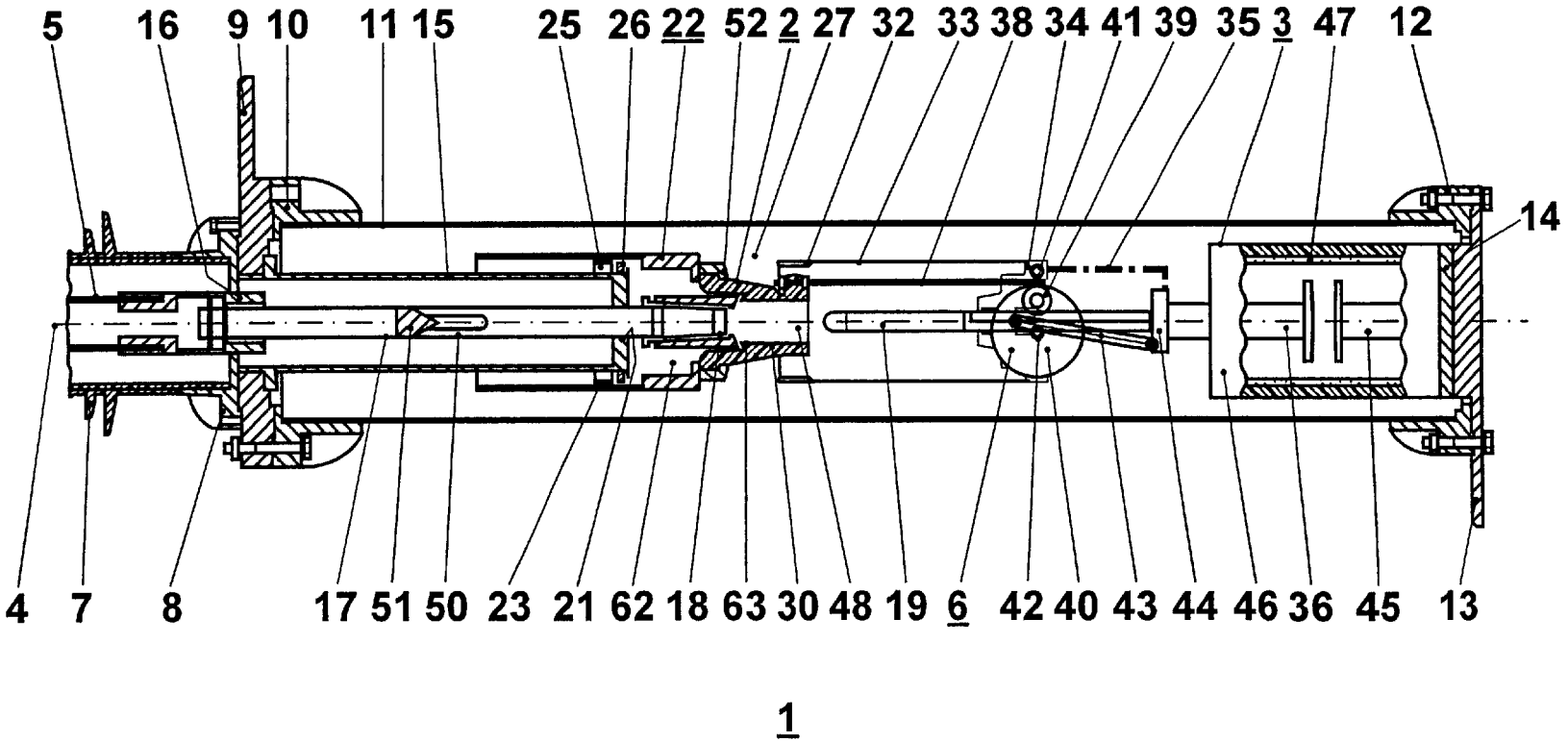
FIG. 5 shows a fourth embodiment of a hybrid circuit breaker, illustrated in highly simplified form, in the disconnected state, in which, as in the third embodiment, the arc in the first arcing chamber is blown out by gas which is stored in a storage volume and is compressed by the arc itself, with a portion of the gas in the storage volume additionally being compressed by means of a piston during disconnection.

FIG. 5 shows a fourth embodiment of a hybrid circuit breaker 1, illustrated in highly simplified form, in the disconnected state. This embodiment is different to the second embodiment shown in FIG. 3 in that it has no separate compression volume separated by a non-return valve. In this case, a cylindrical, somewhat larger blowing volume 62 is connected to the arcing space 48. A part of this blowing volume 62 is mechanically compressed during disconnection. A non-return valve 25 which acts as a compression piston during disconnection and has a valve disk 26 is provided between the blowing volume 62 and the arcing chamber volume 27 and, if the pressure conditions are appropriate, allows gas to flow from the arcing chamber volume 27 into the blowing volume 62. The rest of the design of this hybrid circuit breaker 1 is very similar to that of the second embodiment shown in FIG. 3, but the diameter of the nozzle constriction 63 is considerably larger in the fourth embodiment, which means that the gas pressures that occur in the arcing chamber 2 are considerably lower than the gas pressures which are possible in the second embodiment shown in FIG. 3. This also means that gas which is heated by the arc can flow away through the nozzle constriction 63 and through the interior of the contact tube 17 at this stage, so that it is impossible for any significant backheating to occur into the blowing volume 62.

The openings 50 in the contact tube 17 are likewise shown here, through which gas flowing out of the arcing space 48 can flow away into the interior of the mounting tube 15. This process of flowing away is made easier by a flow cone 51 fitted in the interior of the contact tube 17. By optimizing the size of the blowing volume 62, the diameter of the nozzle constriction 63 of the insulating nozzle 30 and the internal diameter of the contact tube 17, and by matching these three variables to one another, the pressure rise in the arcing space 48, and thus in the blowing volume 62 as well, can be set such that sufficiently effective blowing of the arc is achieved. This fourth embodiment results in the gas being used to blow the arc having a particularly low flow rate, and this flow rate is well into the subsonic range.

In this fourth embodiment of the hybrid circuit breaker 1, the second arcing chamber 3 is likewise always opened with a time delay with respect to the first arcing chamber 2 during disconnection, and is always closed with a time lead during connection, as has already been described.

In this fourth embodiment of the hybrid circuit breaker 1, the diameter of the nozzle constriction 63 of the insulating nozzle 30 is designed to be particularly large. This is determined, for example, from the following relationship, which defines the design parameter F for the nozzle material PTFE with added molybdenum sulfide:

$$F = \alpha \cdot \frac{(I_{max})^2 \cdot E}{R^4} \cdot \frac{kA^2}{mm^3}$$

where $\alpha$ is a factor which is dependent on the material of the insulating nozzle 30, where $I_{max}$ is the maximum current which can be disconnected in kA, where E is the length of the nozzle constriction 63 in mm, and where R is the radius of the nozzle constriction 63 in mm. The factor $\alpha$ is 1 for the nozzle material PTFE with added molybdenum sulfide, and the design parameter F is in the range (0.5–1) $kA^2/mm^3$ for this material. If different nozzle materials are used, then the factor $\alpha$ and the design parameter F must be adapted as appropriate.

Figure 6:
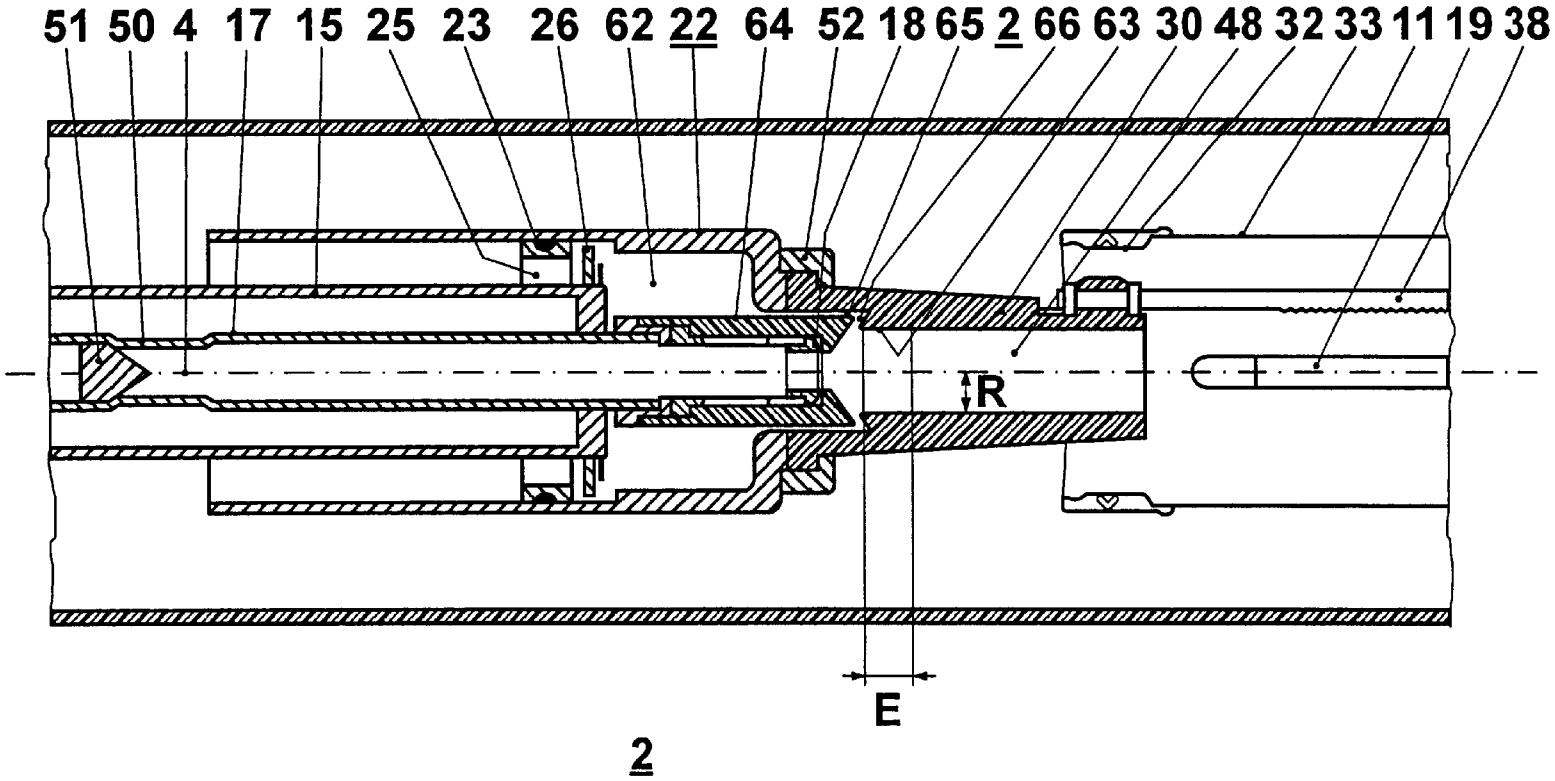
FIG. 6 shows an enlarged partial section through the first arcing chamber of the fourth embodiment of the hybrid circuit breaker.

FIG. 6 shows the nozzle zone of the fourth embodiment of the hybrid circuit breaker 1 somewhat enlarged. The radius R of the nozzle constriction 63 is indicated in this FIG. 6, as is the length E of the nozzle constriction 63. Furthermore, the illustration shows an auxiliary nozzle 64 which is composed of insulating material, covers the outside of the consumable fingers 18 and, together with the insulating nozzle 30, forms a channel 65 which connects the blowing volume 62 to the arcing space 48. By way of example, the channel 65 in this case runs partially parallel to the longitudinal axis 4 and has a bend 66, which runs toward the longitudinal axis 4. The bent channel part runs at an angle in the range from 45° to 90° with respect to the longitudinal axis 4. This bend 66 means that, in the pressure conditions which occur with this embodiment of the hybrid circuit breaker 1, it is impossible for any gas to flow back from the arcing space 48 into the blowing volume 62. This hybrid circuit breaker 1 is designed to be free of back-heating.

In the embodiments of the hybrid circuit breaker 1 described above, it has been found to be particularly advantageous that, depending on the $SF_6$ content in the gas filling of the arc extinguishing chamber 2, the required arc extinguishing pressure in the arcing chamber 2 is less by a factor of 5 to 15 than that in conventional circuit breakers. The drive and the other component as well can therefore be designed for reduced force and pressure zones, which advantageously reduces the costs of the hybrid circuit breaker 1.

If the second arcing chamber 3 is in the form of an assembly composed of switchable power semiconductors, then a fifth embodiment of the hybrid circuit breaker 1 is obtained. In terms of prices, this embodiment can be produced particularly advantageously, and, in particular, this simplifies the gearbox 6 since the second arcing chamber 3 is not operated mechanically. The high-value non-reactive resistor which is used for voltage control during switching is in this case connected in parallel as a component of the assembly of power semiconductors. The disconnection time delay and the time lead with respect to the arcing chamber 2 during connection are in this variant set by means of an electronic controller. A hybrid circuit breaker 1 designed in such a way can be used economically in particular for power supply systems with an operating voltage in the range around 110 kV or below.

In the four embodiments of the hybrid circuit breaker 1 described above, the second arcing chamber 3 is operated mechanically during switching processes and is moved, coordinated with respect to time, from a disconnected position to a connected position, or vice versa. In the respective connected position, the second arcing chamber 3 carries the current flowing through the hybrid circuit breaker. In the fifth embodiment, the second arcing chamber 3 is in the form of an electronically switched semiconductor element, but it likewise carries the current flowing through the hybrid circuit breaker in the connected position. However, it is feasible for an interruptible rated current path to be provided in parallel with the second arcing chamber 3.

Figure 8:
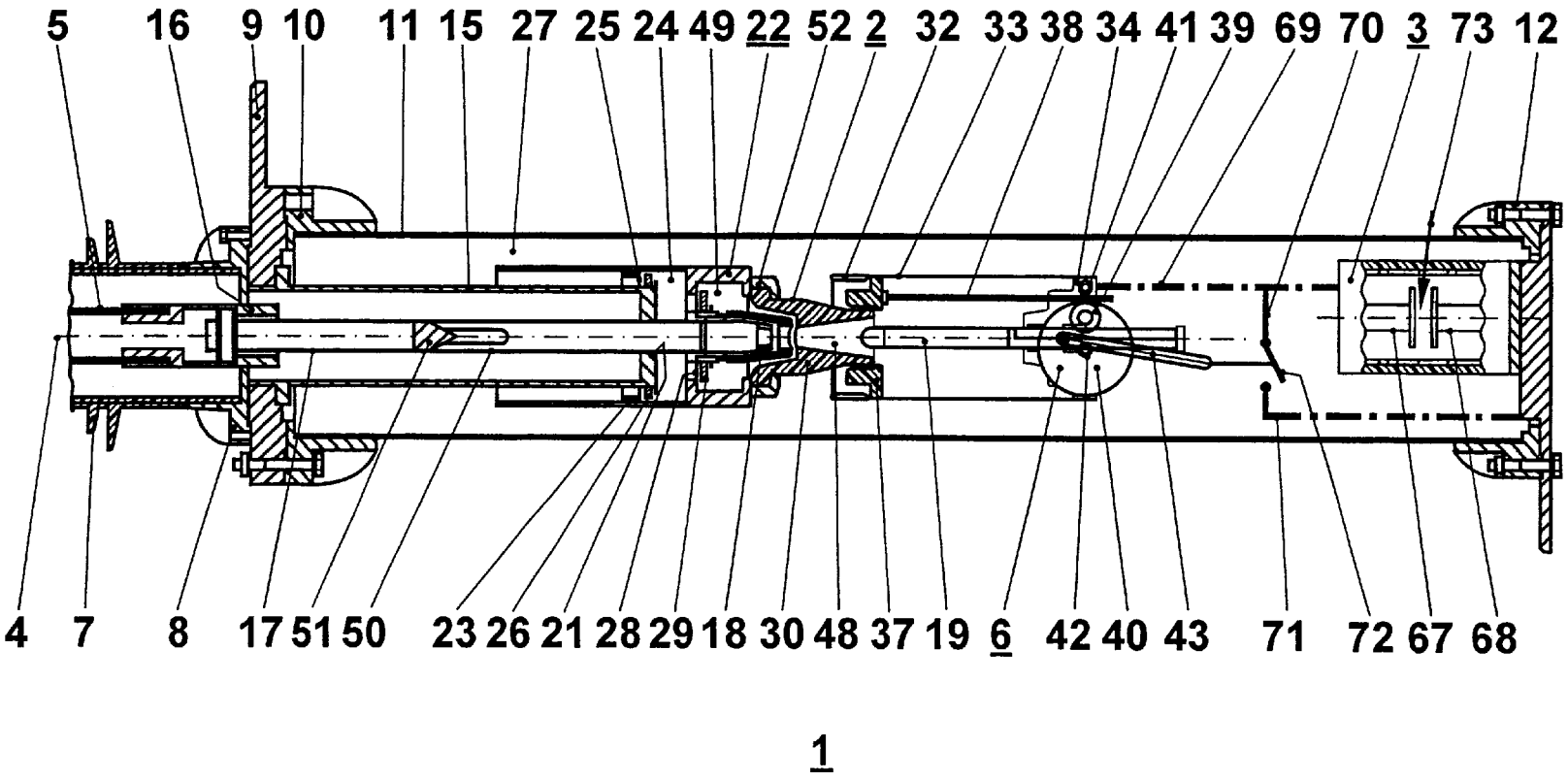
FIG. 8 shows a sixth embodiment of a hybrid circuit breaker, illustrated in highly simplified form, in the disconnected state, in which the second arcing chamber is in the form of a TVG (Triggered Vacuum Gap).

In the sixth embodiment, which is illustrated schematically in FIG. 8, the second arcing chamber 3 is in the form of a TVG (Triggered Vacuum Gap). The two contacts 67 and 68 of the TVG are stationary, and they are not operated mechanically by the gearbox 6. A line of action 69 indicates the electrically conductive connection, which is not illustrated in any more detail, between the first arcing chamber 2 and the second arcing chamber 3. A further line of action 70, which branches off from the line of action 69, indicates the rated current path 71, which runs in parallel with this second arcing chamber 3. The rated current path 71 is designed such that it can be interrupted by means of a disconnector 72 arranged in its course. The disconnector 72 is operated, coordinated with respect to time, from the gearbox 6 by means of the lever 43. An arrow 73 indicates the triggering which is used to introduce charge carriers into the path between the contacts 67 and 68, so that this path becomes electrically conductive.

In this embodiment of the hybrid circuit breaker 1, the first arcing chamber 2 operates as already described previously during disconnection. The electronically controlled triggering indicated by the arrow 73 results in the second arcing chamber 3 becoming electrically conductive and carrying the disconnection current on its own as soon as the disconnector 72 has opened. As a rule, the second arcing chamber 3 is then extinguished at the next current zero crossing, and withstands the first rapid rise of the returning voltage. The first arcing chamber 2 then takes over the entire returning voltage, somewhat later. In this case as well, one of the effective voltage control systems already described is provided for splitting the returning voltage between the two arcing chambers 2 and 3.

What is claimed is:

1. A hybrid circuit breaker, comprising:

first and second arcing chambers which are series-connected and operated by a common drive or by separate drives and are filled with different arc extinguishing media, where the arc extinguishing medium and an insulating medium in a first arcing chamber surrounds a second arcing chamber providing insulation;

means for ensuring that movement of the first arcing chamber leads movement of the second arcing chamber during a disconnection process, and that the movement of the second arcing chamber always leads the movement of the first arcing chamber during a connection process;

wherein a pressurized gas or a gas mixture is used as the arc extinguishing and insulating medium in the first arcing chamber and said second arcing chamber being constructed as a vacuum switching chamber.

2. The hybrid circuit breaker as claimed in claim 1, wherein a pressure rise which occurs in the arc extinguishing and insulating medium in the first arcing chamber during disconnection does not exceed a specific critical pressure range, so that the arc extinguishing and insulating medium always flows at a flow rate in the range below the speed of sound while the arc is being blown.

3. The hybrid circuit breaker as claimed in claim 1, wherein the first arcing chamber has a power current path and a rated current path in parallel with it, and the second arcing chamber has no separate rated current path.

4. The hybrid circuit breaker as claimed in claim 1, wherein both the first arcing chamber and the second arcing chamber have a power current path and a rated current path in parallel with it.

5. The hybrid circuit breaker as claimed in claim 1, wherein pure $SF_6$ gas or a mixture of $N_2$ gas and $SF_6$ gas, or a mixture composed of compressed air with other electrically negative gases, is used as the arc extinguishing and insulating medium in the first arcing chamber.

6. The hybrid circuit breaker as claimed in claimed 1, wherein a mixture composed of $CO_2$ gas with $O_2$ gas is used as the arc extinguishing and insulating medium in the first arcing chamber, in which case the proportion of $O_2$ is in the range from 5% to 30%, or a mixture composed of $CH_4$ gas with $H_2$ gas, in which case the proportion of $H_2$ is in the range from 5% to 30%.

7. The hybrid circuit breaker as claimed in claim 5, wherein a gas mixture with a proportion of from 5% to 50% of $SF_6$ gas is used.

8. The hybrid circuit breaker as claimed in claim 1, wherein the filling pressure of the first arcing chamber is in the range from 3 bar to 22 bar.

9. The hybrid circuit breaker as claimed in claim 1, further comprising means for ensuring a voltage distribution between the first arcing chamber and the second arcing chamber in the course of a switching process.

10. The hybrid circuit breaker as claimed in claim 9, wherein resistive-capacitive means are provided for the voltage distribution between the first arcing chamber and the second arcing chamber.

11. The hybrid circuit breaker as claimed in claim 10, wherein the second arcing chamber is rigidly bridged by a non-reactive resistor.

12. The hybrid circuit breaker as claimed in claim 11, wherein the value of the non-reactive resistor is in the range between 10 and 500 kΩ.

13. The hybrid circuit breaker as claimed in claim 1, wherein a time lead $T_v$ of the movement of the first arcing chamber with respect to the second arcing chamber during disconnection is defined by the following relationship:

$$T_v=(t_{Libo\ min}-t_1)ms$$

wherein $t_{Libo\ min}$ is the minimum possible arcing time for the first arcing chamber, and $t_1$ is a time in the range from 2 ms to 4 ms.

14. The hybrid circuit breaker as claimed in claim 1, wherein the pressurized gas in the first arcing chamber is produced a) in a compression volume or b) in a compression volume which interacts with a separate storage volume for storage of the gas component which is produced by arc assistance, or c) in a partially compressible storage volume for storage of the gas component which is produced by arc assistance, or d) in a blowing volume, which can be only partially compressed, without arc assistance.

15. The hybrid circuit breaker as claimed in claim 14, wherein a design parameter F for a nozzle constriction of an insulating nozzle for a variant of the hybrid circuit breaker in which the pressurized gas which is required for blowing out the arc in the first arcing chamber is produced in a blowing volume which can be only partially compressed without arc assistance is determined from the following relationship:

$$F = \alpha \cdot \frac{(I_{max})^2 \cdot E}{R^4} \cdot \frac{kA^2}{mm^3}$$

where α is a factor which is dependent on the material of the insulating nozzle, where $I_{max}$ is the maximum current which can be disconnected kA, where E is the length of the nozzle constriction in mm, and where R is the radius of the nozzle constriction in mm.

16. The hybrid circuit breaker as claimed in claim 15, wherein the design parameter F is in the range of (0.5–1) $kA^2/mm^3$ when using PTFE with added molybdenum sulfide as the nozzle material for the insulating nozzle.

17. The hybrid circuit breaker as claimed in claim 1, wherein the second arcing chamber is in the form of a TVG (Triggered Vacuum Gap).

18. A hybrid circuit breaker, comprising:

at least first and second series-connected arcing chambers which are operated by a common drive or by separate drives and are filled with different arc extinguishing media, where the arc extinguishing media and an insulating medium of a first arcing chamber surrounds a second arcing chamber providing insulation;

means for ensuring that the movement of the first arcing chamber leads the movement of the second arcing chamber during a disconnection process, and that the movement of the second arcing chamber always leads the movement of the first arcing chamber during a connection process, wherein a pressurized gas or a gas mixture is used as the arc extinguishing and insulating medium in the first arcing chamber, and wherein the two arcing chambers have different arc extinguishing media.

19. The hybrid circuit breaker as claimed in claim 18, wherein a gas or gas mixture is used as the arc extinguishing and insulating medium in the first arcing chamber and wherein the at least one switchable power semiconductor is provided as the second arcing chamber.

20. A method for disconnection of a hybrid circuit breaker having a steps connected first and second arcing chamber, comprising the steps of:

a) opening the first arcing chamber before the second arcing chamber, b) maintaining a pressure which occurs in an arcing space during disconnection at a level that does not exceed a specific critical pressure range, c) blowing out the arc using a flow rate at a level below the speed of sound, d)distributing a majority of a returning voltage following the extinguishing of the arc to the second arcing chamber, and e) transferring a majority of an applied voltage to the first arcing chamber.

21. The method as claimed in claim 20, wherein during the disconnection process, the voltage distribution between the two arcing chambers is achieved by means of resistive-capacitive or resistive control.

22. The method as claimed in claim 20, wherein a hybrid circuit breaker is used in this case.

23. The hybrid circuit breaker as claimed in claim 1, wherein the filling pressure of the first arcing chamber is approximately 9 bar.

24. The hybrid circuit breaker as claimed in claim 11, wherein the value of the non-reactive resistor is preferably 100 kΩ.

* * * * *